US005403237A

United States Patent [19]

Gurevich

[11] Patent Number: 5,403,237

[45] Date of Patent: Apr. 4, 1995

[54] MANIFOLDING BOOK ARTICLE

[76] Inventor: Grigory Gurevich, 282 Barrow St., Jersey City, N.J. 07302

[21] Appl. No.: 82,777

[22] Filed: Jun. 28, 1993

[51] Int. Cl.[6] ..... B42D 1/00; B42D 5/00

[52] U.S. Cl. ..... 462/59; 462/60; 462/61; 462/84; 281/2; 281/16; 281/38

[58] Field of Search ..... 281/2, 15.1, 16, 21.1, 281/27, 38, 40, 41, 51; 462/7, 57-61, 66, 84

[56] References Cited

U.S. PATENT DOCUMENTS

| | | | |
|---|---|---|---|
| 1,882,384 | 10/1932 | Huffman | 462/61 |
| 2,352,134 | 6/1944 | Stone | 462/60 |
| 4,586,729 | 5/1986 | Beylerian | 281/2 X |
| 4,810,007 | 3/1989 | Nam | 281/38 X |
| 4,822,074 | 4/1989 | Heuffman et al. | 281/2 X |
| 4,932,679 | 6/1990 | Mayer et al. | 281/16 X |
| 4,955,640 | 9/1990 | Anderson | 281/2 |
| 5,018,764 | 5/1991 | Beardell | 281/15.1 X |
| 5,171,039 | 12/1992 | Dusek | 281/2 X |

FOREIGN PATENT DOCUMENTS

| | | | |
|---|---|---|---|
| 535605 | 4/1941 | United Kingdom | 462/61 |

*Primary Examiner*—Peter Dungba Vo
*Attorney, Agent, or Firm*—I. Zborovsky

[57] ABSTRACT

A manifolding book has at least two leaves each having a first side and a second side and a first longitudinal edge and a second longitudinal edge and a binding connecting the leaves with one another and including at least one connecting element which connects the first edge of one of the leaves with the first edge of another of the leaves and another connecting element which connects the second edge of the one leaf with the second edge of the another leaf, so that the leaves can be moved between two open positions including one open position in which one of the leaves is located at the left side while another of the leaves is located at the right side and another open position in which the first leaf is located at the right side and the second leaf is located at the left side, and also between two folded positions including one folded position in which the first sides of the leaves face one another and another folding position in which the second sides of the leaves face one another.

4 Claims, 3 Drawing Sheets

MANIFOLDING BOOK ARTICLE

BACKGROUND OF THE INVENTION

The present invention relates to a manifolding book and similar manifolding articles.

Manifolding books are generally known in the art. Some manifolding books are disclosed for example in U.S. Pat. Nos. 1,772,035, 1,247,233 and others. Manifolding books include a plurality of leaves which are connected with one another by a binding. Various types of leaves and bindings are known. It is to be understood that further modifications of manifolding books are desirable to increase their attractiveness, convenience and versatility.

SUMMARY OF THE INVENTION

Accordingly, it is an object of the present invention to provide a manifolding book article, which is a further improvement of the existing manifolding books.

In keeping with these objects and with others which will become apparent hereinafter, one feature of the present invention resides, briefly stated, in a manifolding book which has at least two leaves each having two longitudinal edges and two opposite sides, and a binding connecting said two leaves with one another and including one connecting element which includes one edge of one leaf with one edge of another leaf and another connecting element which connects another edge of the one leaf with another edge of the another leaf, so that in one folded position one side of one of the leaves faces one side of the other of the leaves, while in another folded position another side of one leaf faces another side of another leaf.

When the manifolding book is designed in accordance with the present invention, it can be folded in two different ways and both sides of each leaf are available for presentation of corresponding images.

In accordance with another feature of the present invention, there are two first connecting elements and two second connecting elements which connect corresponding edges of the leaves with one another.

In accordance with still a further important feature of the present invention, the manifolding book has a third leaf and two additional connecting elements which connect one of the first two leaves with the third leaf similarly, so that the one of the first two leaves and the third leaf can also be folded to be in one of the two different positions. When the manifolding book has at least three leaves connected in the above mentioned manner, the book is further very attractive since the leaf is folded in two opposite directions including the first direction about its longitudinal axis and a second direction about its transverse axis. Also, it is to be understood that many more leaves can be connected in the same manner in which case the book becomes even more versatile. Also, special figures can be formed from such a manifolding book.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
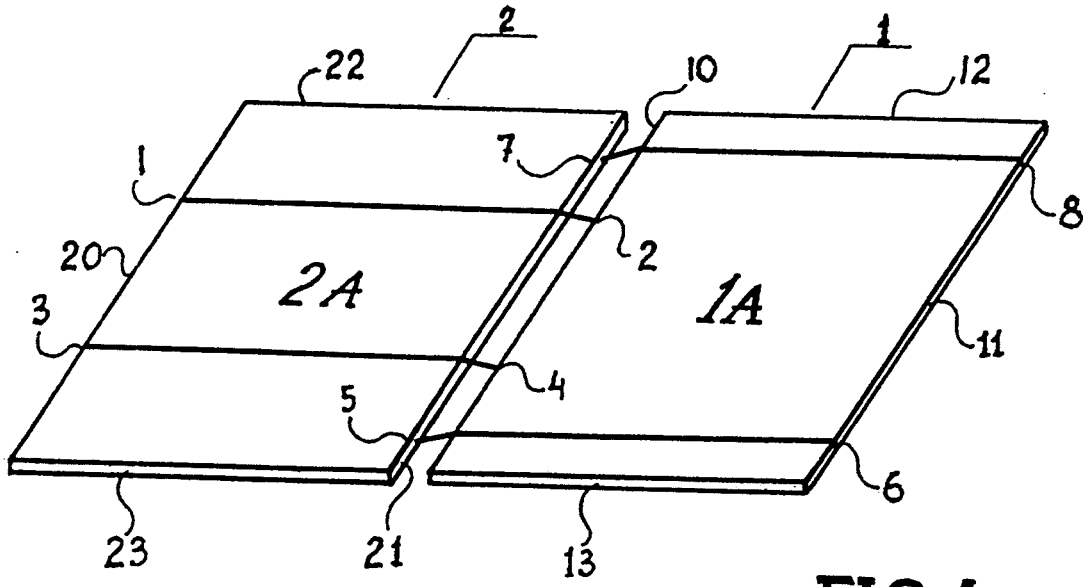
FIG 1 is a view showing a manifolding book in accordance with the present invention which is opened in one position.

A manifolding book in accordance with the present invention has at least two leaves which are identified as a whole with reference numerals 1 and 2. The leaves 1 and 2 have corresponding first sides 1A and 2A and second sides 1B and 2B. Also, the leaf 1 has two longitudinal edges 10 and 11 while the leaf 2 has two longitudinal edges 20 and 21.

The book further has a binding which includes two first connecting elements 12 and 13 which connect one proximal edge 21 of the leaf 2 in points 7 and 5 correspondingly with one distal edge 11 of the leaf 1 in two further points 8 and 6 correspondingly. The binding further has two further connecting elements 22 and 23 which connect a distal edge 20 of the element 2 in two points 1 and 3 with a proximal edge 10 of the leaf 1 in two points 2 and 4 correspondingly. In the shown embodiment the connecting elements 12 and 13 and 22 and 23 extend parallel to one another. However, they can extend in other directions as well.

Figure 2:
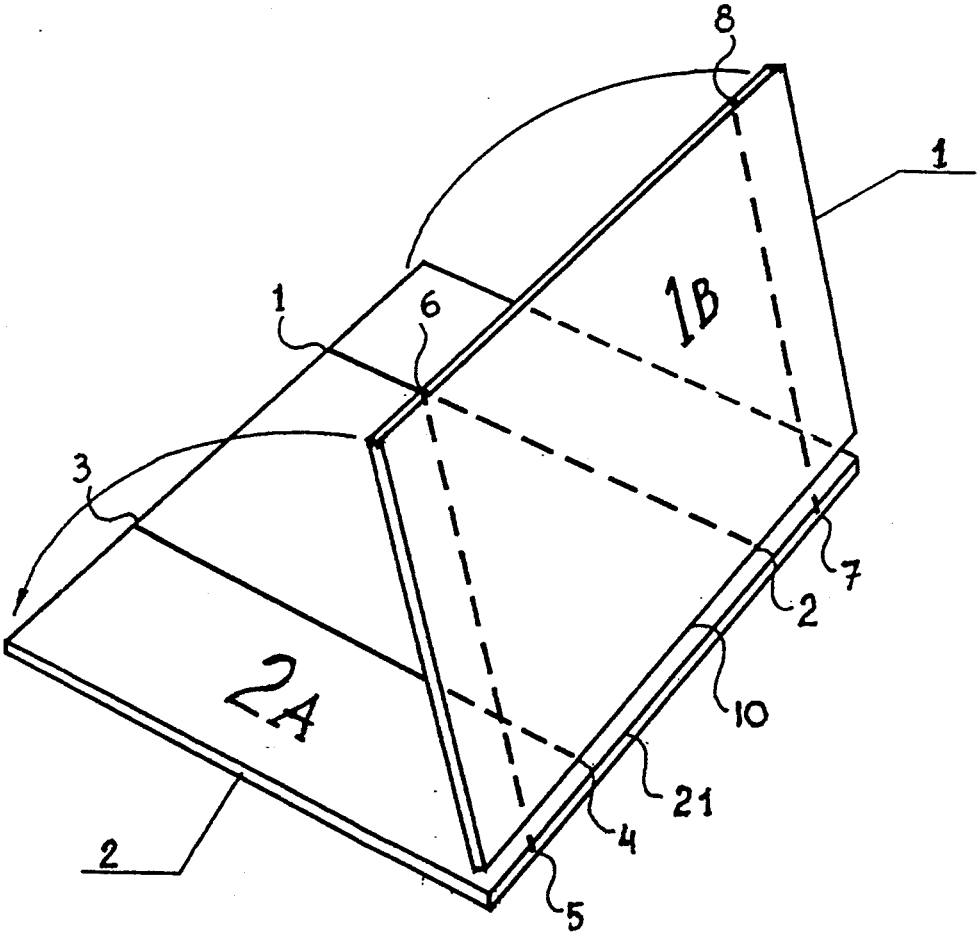
FIG. 2 is a view showing the manifolding book which is about to be folded into one position.
Figure 3:
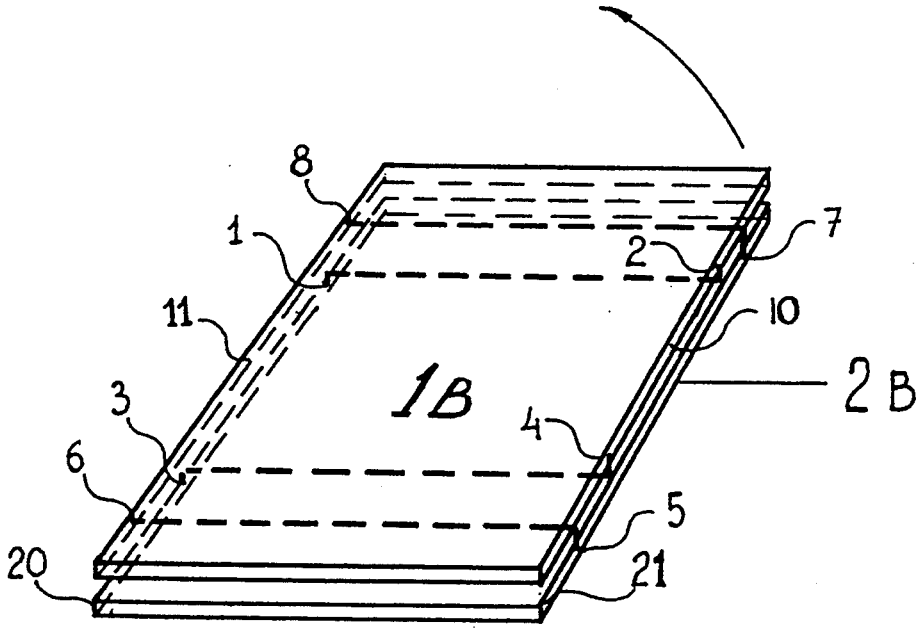
FIG. 3 view showing the completely folded manifolding book in the one position.
Figure 4:
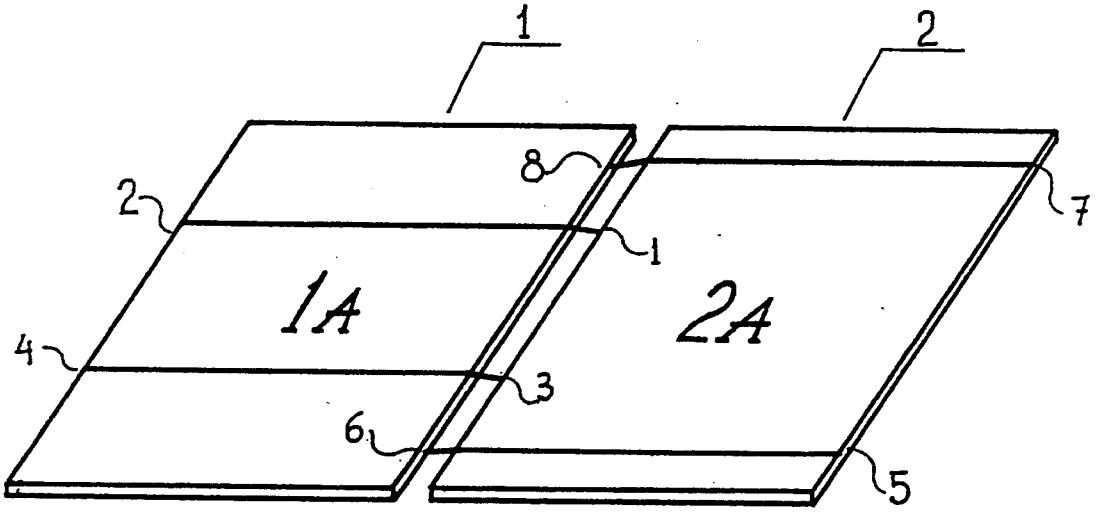
FIG. 4 is a view showing the manifolding book in accordance with the present invention which is open in another position.

As can be seen from FIG. 1, the manifolding book is open in one position in which sides 1A and 2A of the leaves 1 and 2 face upwardly. In FIG. 2 a user starts folding the manifolding book so as to close it, or in other words to put together the sides 1A and 2A of the leaves 1 and 2. In FIG. 3 the book is closed in this manner. Then a user grasps the edge 10 of the leaf 1 and lifts it upwardly so as to open the book in the position shown in FIG. 4. While in the position shown in FIG. 1 the leaf 1 is located at the right side and the leaf 2 is located at the left side, in the position shown in FIG. 4 the leaf 1 is located at the left side and the leaf 2 is located at the right side. In the next step the user can fold the book into an opposite position in accordance with the arrow shown in FIG. 4 so that now the sides 1B and 2B come together, while the sides 1A and 2A will be located outside, contrary to the folding position shown in FIG. 3 in which the sides 1B and 2B are located outside while the sides 1A and 2A are located inside.

Figure 5:
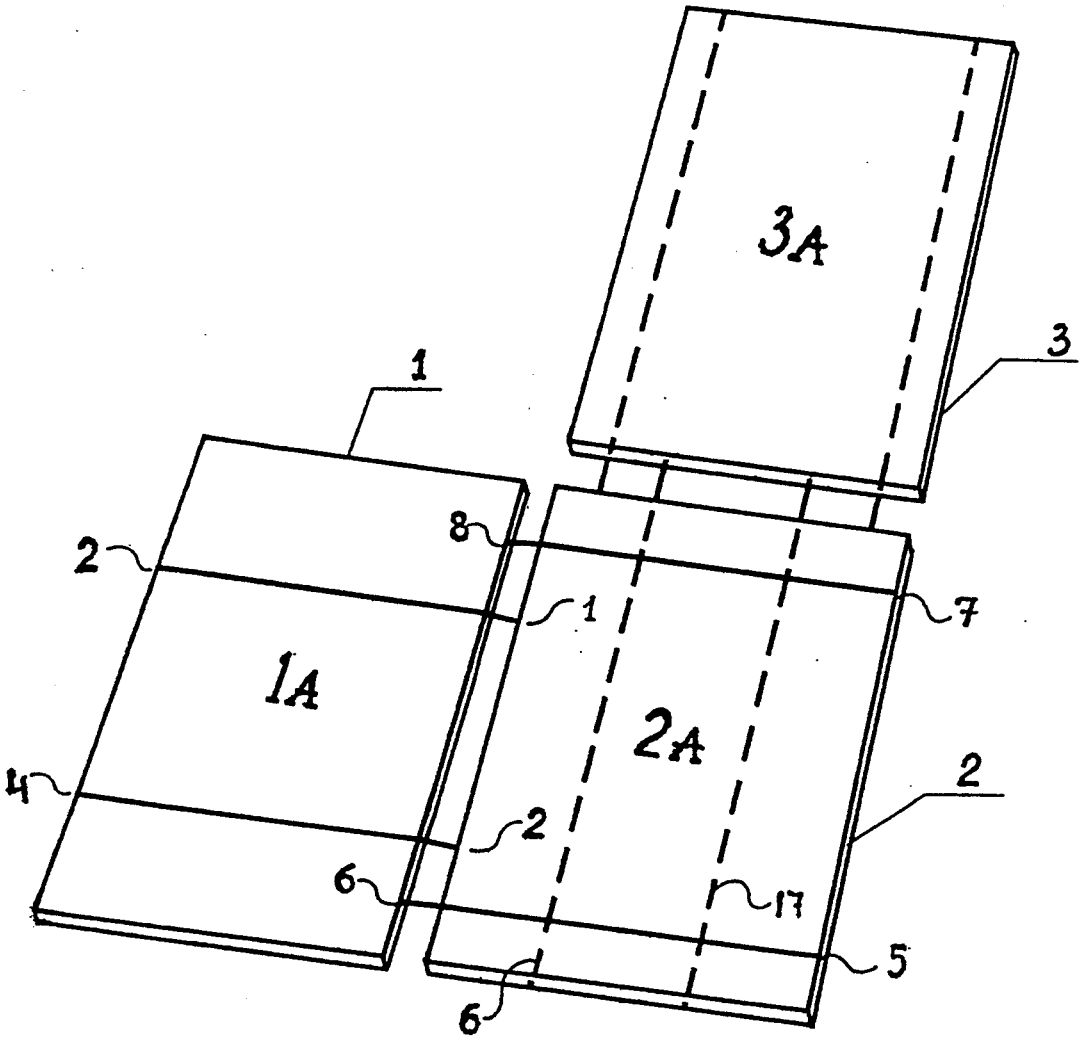
FIG. 5 is a view showing a further modification of the manifolding book of the invention.

In the embodiment shown in FIG. 5, the manifolding book has a third leaf identified with reference numeral 3 and having two opposite sides 3A and 3B. The leaf 3 is connected with the leaf 2 by their transverse edges. In particular the leaf 2 has transverse edges 14 and 15 while the leaf 3 has transverse edges 31 and 32. Two connecting elements 16 and 17 connect the transverse edge 14 of the leaf 2 with the transverse edge 31 of the leaf 3, while further two connecting elements 32 and 33 connect the transverse edge 15 of the leaf 2 with a transverse edge 32 of the leaf 3. The leaves 2 and 3 are also foldable relative to one another between two different open positions and two different folded positions. As for the two different open positions the side 2A of the leaf 2 can be located above the side 3A of the leaf 3 or vice versa below the same. As for the two folded positions, the sides 2A and 3A of the leaves 2 and 3 can face one another in one folded position, while the sides 2B and 3B of the leaves 2 and 3 can face one another in another folded positions.

The novel features of the present invention are not limited to the details shown, since various modifications and structural changes are possible without departing in any way from the spirit of the present invention.

What is desired to be protected by Letters Patent is set forth in particular in the appended claims.

I claim:

1. A manifolding book, comprising at least two leaves including a first leaf and a second leaf and each having a first surface and a second surface and a proximal longitudinal edge located in each of said leaves closer to the other of said leaves and a distal longitudinal edge located in each of said leaves further from the other of said leaves when the book is open and said leaves are located side by side, said longitudinal edges being parallel to one another; and a binding connecting said leaves with one another and including at least one connecting element which connects said distal edge of said first leaf with said proximal edge of said second leaf and another connecting element which connects said proximal edge of said first leaf with said distal edge of said second leaf, so that said leaves can be moved between two open positions including one open position in which when the book is open, said first leaf is located at the left side while said second leaf is located at the right side as viewed by a viewer and another open position in which said first leaf is located at the right side and said second leaf is located at the left side as viewed by a viewer, and also between two folded positions including one folded position in which the first surfaces of said leaves face one another and another folding position in which said second surfaces of said leaves face one another.

2. A manifolding book as defined in claim 1, wherein said connecting elements extend parallel to one another.

3. A manifolding book as defined in claim 1; and further comprising two further connecting elements each extending parallel to a respective one of said first mentioned connecting elements, one of said further connecting elements extends parallel to said one connecting element and connects said distal edge of said first leaf with said proximal edge of said second leaf, while the other of said further connecting elements extends parallel to the other connecting element and connects said proximal edge of said first leaf with said distal edge of said second leaf.

4. A manifolding book as defined in claim 1; and further comprising at least one third leaf connected with one of said first mentioned two leaves, said third leaf and said at least one of said two first mentioned connecting leaves each having a distal transverse edge and a proximal transverse edge extending parallel to one another; and at least two additional connecting elements including one additional connecting element which connects said distal transverse edge of said third leaf with said proximal transverse edge of at least one of said two first mentioned leaves and another additional connecting element which connects said proximal transverse edge of said third leaf with said distal transverse edge of said at least one of said two first mentioned leaves, so that said third leaf and said at least one of said first mentioned leaves are movable relative to one another between two different open positions and two different closed positions.

* * * * *